United States Patent [19]

Cremer et al.

[11] Patent Number: 4,821,484

[45] Date of Patent: Apr. 18, 1989

[54] DOUBLE FLOOR CONSTRUCTION

[75] Inventors: Gottfried Cremer, Cologne; Martin Bard, Amberg, both of Fed. Rep. of Germany

[73] Assignee: Buchtal Gesellschaft mit beschrankter Haftung, Fed. Rep. of Germany

[21] Appl. No.: 10,203

[22] Filed: Feb. 3, 1987

[30] Foreign Application Priority Data

Feb. 3, 1986 [DE] Fed. Rep. of Germany ..... 3603232

[51] Int. Cl.[4] ..... E04C 2/34

[52] U.S. Cl. ..... 52/806; 52/811; 428/116

[58] Field of Search ..... 52/799, 806, 807, 808, 52/263, 811, 309.9; 428/116, 118

[56] References Cited

U.S. PATENT DOCUMENTS

| | | | |
|---|---|---|---|
| 3,450,593 | 6/1969 | Fossier et al. | 52/806 X |
| 3,895,152 | 7/1975 | Carlson et al. | 52/309.14 X |
| 3,938,764 | 2/1976 | McIntyre et al. | 49/141 X |
| 4,428,993 | 1/1984 | Kohn et al. | 52/807 |
| 4,617,072 | 10/1986 | Merz | 428/116 X |

OTHER PUBLICATIONS

Fussboden Forum, No. 1, pp. 95–96, Jan. 1986.

German Utility Model 84 30 185.6, "Doppelboden Platte".

German Utility Model 81 06 740.2, "Fussboden Platte Für Doppelböden".

*Primary Examiner*—Carl D. Friedman

*Attorney, Agent, or Firm*—Kinney & Lange

[57] ABSTRACT

A double floor contruction is proposed which has supports set up at predetermined intervals on a stable substructure and tile-like floor elements bedded directly or indirectly on said supports. Each tile-like floor element is formed by a composite construction of a plurality of superposed layers of different materials, whereby the composite contruction is composed of a cover tile made of ceramic material, a core layer made of rigid material with low volume weight and a thin bottom layer with high tensile strength properties. This double floor construction solves the problem of allowing for the individual tile-like floor elements to be optimally selected in terms of their dimensions, in particular their thickness, while nevertheless being capable of taking up high loads. It also allows for the surface to be resistant to organic solvents and other chemicals. Finally, the floor coverings do not require for their bond with the subfloor any adhesive that might be critical in terms of its stability.

13 Claims, 1 Drawing Sheet

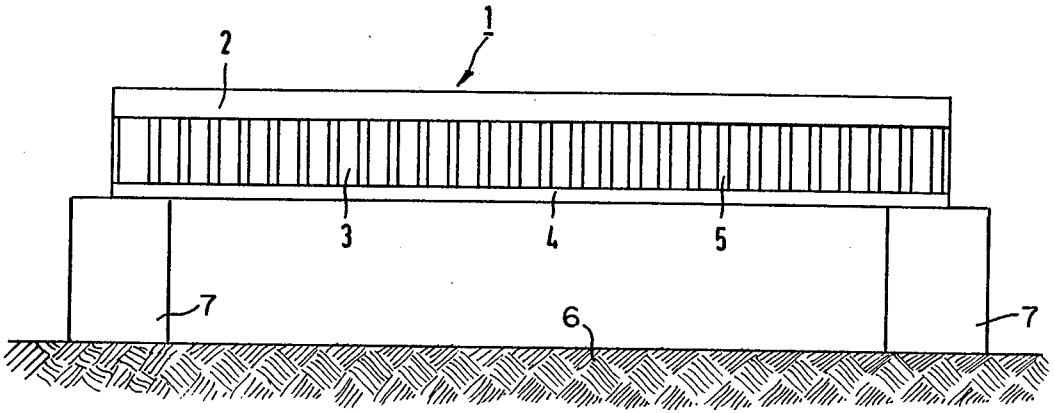
1
2
3
4
5
6
7
7

DOUBLE FLOOR CONSTRUCTION

BACKGROUND OF THE INVENTION

1. Field of the Invention.

The present invention relates to a double floor construction comprising supports set up at predetermined intervals on a stable substructure and tile-like floor elements bedded directly or indirectly on said supports, with each tile-like floor element formed by a composite construction of a plurality of superposed layers of different materials.

2. Description of the Prior Art.

One group of such floor elements that is predominantly used comprises trough-like structures made of sheet metal or steel frames combined with a sheet metal floor. The filling of these troughs consists of different materials such as gypsum, concrete, wood fiber materials or the like. The extension of the trough case by a chip board core serving as a filling is also used. Another group of such floor elements consists in steel pipe profiles or aluminum castmetal plates.

The uppermost layer in both groups is either carpeting or a hard PVC covering. All static loads that occur must thus be taken up by the trough construction since these coverings cannot play any party thereby.

Nowadays, however, double floor constructions are expected to meet the requirement of up to 1000 kg/element dimensioned 60×60 cm. Such requirements necessitate a considerable increase in the thickness of the elements, which may increase the price of the overall construction and lead to difficulties in dimensioning the height between floors. Furthermore, such elements are of course much heavier, which has an adverse effect on the dimensioning of the stable substructure.

The invention is based on the problem of developing a double floor construction in which the individual tile-like floor elements can be optimally selected in terms of their dimensions, in particular their thickness, and which can still take up high loads. Furthermore, the surface should be resistant to organic solvents and other chemicals and, finally, the floor coverings should not require for their bond with the subfloor any adhesives that are critical in terms of their stability.

SUMMARY OF THE INVENTION

This problem on which the invention is based is solved by composing the composite construction of a cover tile made of ceramic material, a core layer made of rigid material with low volume weight and a thin bottom layer with high tensile strength properties. Such a construction allows for a considerable reduction in weight compared to the known constructions, much higher static strength, a saving of height in the floor construction with the same space between or a larger space between with the same height. Furthermore, no metal element is present that might possibly corrode.

The various layers of the composite construction are preferably joined together using an adhesive, optionally under the effect of pressure.

It is particularly expedient for the cover tile to consist of a tile with high crushing strength that is pressed out of plastic ceramic starting material, rolled and fired, whose thickness is 1:45000 relative to the surface with a superficial extent of the tile of approximately 30×30 cm.

A highly porous material or honeycombed material is preferably used as the core layer, whereby the latter case the honeycomb axes should be disposed perpendicular to the cover tile. The core may also be made of ceramic material that can be worked without difficulties into a highly porous shaped body or into a honeycomb element. The bottom layer is preferably made of glass, mineral, carbon or synthetic fibrous tissue or nonwoven tissue. When ceramic material is used for the core layer and/or glass, mineral or carbon fibers as the material for the bottom layer, the bond is expediently effected by a glaze-like material whose melting point is lower than the quartz transition point (573° C.).

BRIEF DESCRIPTION OF THE DRAWING

The drawing shows in one figure a cross-section of a floor element as can be used to construction the inventive double floor construction.

DETAILED DESCRIPTION OF THE PREFERRED EMBODIMENTS

Number 1 refers generally to the composite construction composed of a cover tile 2 made of ceramic material, a core layer 3 made of rigid material with low volume weight and a thin bottom layer 4 with high tensile strength properties.

In the selected embodiment the core layer consists of a ceramic honeycomb element whose honeycomb openings are referred to as 5.

What is claimed is:

1. A tile-like floor element for use in double floor construction of the type having supports set up at predetermined intervals on a stable substructure and a plurality of the tile-like floor elements bedded directly or indirectly on said supports, with each of the tile-like floor elements formed by a composite construction of a plurality of superposed layers of different materials, characterized in that the composite construction is composed of a cover tile made of ceramic material, a core layer made of rigid material with low volume weight, and a bottom layer thinner than the cover tile and with high tensile strength properties, and wherein the superposed layers are bonded together.

2. A tile-like floor element according to claim 1, characterized in that the superposed layers of the composite construction are bonded together using an adhesive.

3. A tile-like element according to claim 2 wherein the adhesive bond is effected under pressure.

4. A tile-like floor element according to claim 1, characterized in that the cover tile consists of a tile with high crushing strength that is pressed out of plastic ceramic starting material, rolled and fired and whose thickness is 1:45000 relative to the surface with a superficial extent of the tile approximately 30×30 cm.

5. A tile-like floor element according to claim 1, characterized in that the core layer is made of highly porous material.

6. A tile-like floor element according to claim 1, characterized in that the core layer is made of a honeycombed ceramic material whose honeycomb axes are disposed perpendicular to the cover tile.

7. A tile-like floor element according to claim 1, characterized in that the core layer consists of ceramic material, and the bottom layer comprises:

glass, mineral or carbon fibers; and the bond therebetween is effected by a glaze-like material whose melting point is lower than the quartz transition point (573° C.).

8. A tile-like floor element for use in double floor construction of the type having supports set up at predetermined intervals on a stable substructure and a plurality of the tile-like floor elements bedded directly or indirectly on said supports, with each of the tile-like floor elements formed by a composite construction of a plurality of superposed layers of different materials, characterized in that the composite construction is composed of a cover tile made of ceramic material, a core layer made of rigid material with low volume weight, and a bottom layer made of a material with high tensile strength properties such as glass, mineral, carbon or synthetic fibrous tissue or nonwoven tissue which is thinner than the cover tile, and wherein the superposed layers are bonded together.

9. A tile-like composite floor element, suitable for use in a double floor construction which has a stable substructure and supports for said tile-like floor elements, the tile-like composite floor element comprising:

a ceramic cover layer;

a rigid, low density core layer; and a, bottom layer thinner than the ceramic cover layer and formed of material having high tensile strength, wherein the layers are bonded together.

10. The tile-like composite floor element of claim 9 wherein the layers are bonded together with an adhesive.

11. The tile-like composite floor element of claim 10 wherein the adhesive bond is effected under pressure.

12. The tile-like composite floor element of claim 9 wherein the ceramic cover layer is a thin tile with a high crushing strength.

13. The tile-like composite floor element of claim 9 wherein the dimensions of thickness to surface area of the ceramic cover layer are approximately 1:45,000 for a floor element having a surface area of approximately 30×30 cm.

* * * * *